US007269377B2

(12) United States Patent
Mori

(10) Patent No.: US 7,269,377 B2
(45) Date of Patent: Sep. 11, 2007

(54) PROCESS CARTRIDGE

(75) Inventor: Masakazu Mori, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 600 days.

(21) Appl. No.: 10/461,449

(22) Filed: Jun. 16, 2003

(65) Prior Publication Data

US 2004/0042817 A1 Mar. 4, 2004

(30) Foreign Application Priority Data

Jun. 19, 2002 (JP) ..... 2002-178079

(51) Int. Cl.
*G03G 21/18* (2006.01)

(52) U.S. Cl. ..... 399/113; 399/107

(58) Field of Classification Search ..... 399/107, 399/113

See application file for complete search history.

(56) References Cited

U.S. PATENT DOCUMENTS 4,757,344 A * 7/1988 Idenawa et al. ..... 399/113
5,051,778 A * 9/1991 Watanabe et al. ..... 399/25
5,369,479 A * 11/1994 Tsuyuki ..... 399/113
5,406,335 A 4/1995 Nikoh ..... 348/642

FOREIGN PATENT DOCUMENTS

JP 63-10424 3/1988
JP 2-61655 3/1990
JP 07175313 A * 7/1995

OTHER PUBLICATIONS

Proper Printer, May 1, 1992, Oakland Tribune, Abstract.*

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

A process cartridge detachably mountable to an image forming apparatus for forming an image on a recording material includes a first unit including at least an image-bearing member, a second unit including at least a developing device for developing an electrostatic image formed on the image-bearing member, and a connector for separably connecting the first unit and the second unit with each other, which permits integral mounting and demounting of the first and second units relative to the image forming apparatus. The second unit has a life which substantially equals to the life of the image forming apparatus, and the first unit is replaceable by separation thereof from the second unit outside the image forming apparatus.

3 Claims, 7 Drawing Sheets

PROCESS CARTRIDGE

FIELD OF THE INVENTION AND RELATED ART

The present invention relates to a process cartridge which is detachably mountable to an image forming apparatus, such as a copying machine, a printer, a facsimile apparatus, etc., for forming an image by utilizing an electrophotographic process or an electrostatic recording process.

FIG. 6 is a schematic sectional view (front view) of an embodiment of a conventional image forming apparatus and illustrates an entire structure of an image forming apparatus 500 which is a so-called digital copying machine.

Referring to FIG. 6, the image forming apparatus 500 of this embodiment includes an original read portion 510 provided with an automatic document feeder disposed at an upper portion of the apparatus 500, an image forming portion 520 disposed substantially at a central portion of the apparatus 500, and a (paper) feeding portion 530 disposed at a lower and a right-side portion of the image forming portion 520.

The image forming portion 520 includes, for example, an integral-type process cartridge 526 including integrally a photosensitive drum 521 which is an electrophotographic photosensitive member, a charging roller 522 for charge-treating the surface of the photosensitive drum 521, a developing device 523 for visualizing an electrostatic image on the photosensitive drum 521, a toner containing means 524 which contains a toner to be supplied to the developing device 523, and a cleaning device 525 for removing and recovering residual toner image remaining on the photosensitive drum 521; an exposure apparatus (laser scanner unit) 527 disposed above the process cartridge 526; a transfer roller 528, disposed opposite to the photosensitive drum 521, for transferring a toner image formed on the photosensitive drum 521 onto a sheet S; a fixing device 541 for effecting heat fixation treatment to the sheet S onto which the toner image has been transferred; and a pair of discharge rollers 542, which is integrally constituted with the fixing device 541 for discharging the fixation-treated sheet S outside the image forming apparatus 500.

In the feeding portion 530; a (paper) feeding cassette 531 capable of accommodating sheets S having A4 size or a size smaller than A4 size; a feeding roller 532 for feeding the sheets S toward the image forming portion 520; and an intermediary plate 533 for lifting up the sheets S so that a leading end of the sheet S abuts the feeding roller 532; are disposed. The sheet S fed by the feeding roller 532 is once stopped by a pair of register rollers 535 through a conveyance roller 534 and is fed after it is timed to the toner image formed on the photosensitive drum 521. In some cases, the sheet S it fed from a manual feed portion 536 disposed on a right-side to the register roller pair 535.

In the original read portion 510 an original supporting platen glass 512, a contact image sensor 513, a supporting shaft 514 for supporting the contact image sensor 513, and a reader motor 515 for driving the contact image sensor 513 are disposed. An original is placed on the original supporting platen glass 512 and is subjected to scanning with the contact image sensor 513, whereby image reflected light is converted into an electric signal.

When the photosensitive drum 521 surface which has been uniformly charged by a charge roller 522 is subjected to exposure to an image light L, issued from a laser (beam) scanner unit 527, converted from the electric signal which has been converted from the original image reflected light at the original read portion 510, an electrostatic image is formed on the photosensitive drum 521. After the electrostatic image is developed as a toner image (visualized image) by the developing device 523 together with the rotation of the photosensitive drum 521, the toner image is transferred onto a sheet S, which is timed to the toner image by the register roller pair 535, fed from the feeding portion 530 by a transfer roller 528. Incidentally, the surface of the photosensitive drum 521 after completion of the transfer is cleaned by the cleaning device 525 to prepare a subsequent image formation process. The sheet S after the transfer is completed is subjected to heat fixation at the time when the toner image on the sheet S passes through the fixing device 541, and after being fixed, is discharged outside the image forming apparatus 510 by the discharge roller pair 542.

FIG. 7 illustrates a method of mounting and demounting the integral-type process cartridge 526 from the image forming apparatus 500.

In the image forming apparatus 500, it is necessary for a user of the image forming apparatus to perform demounting and mounting of the integral-type process cartridge 526 at the time of replacement of the process cartridge 526 or post-treatment for paper jamming at the image forming portion 520. The demounting and mounting of the process cartridge 526 is performed in such a manner that the original read portion 510 is moved horizontally in a left-hand direction as shown in FIG. 7, and from an opening portion 503 which has appeared substantially above the image forming portion 520, the integral-type process cartridge 526 may be detached from and attached to a main assembly 511 of the image forming apparatus 500 in a direction of an indicated arrow. More specifically, the user of the image forming apparatus demounts and mounts the integral-type process cartridge 526 along a cartridge guide portion 504 while holding a gripping portion 526*a*. Incidentally, an explanation on a mechanism and structure for performing the horizontal movement of the original read portion 510 will be omitted.

As described above, the image forming process by the conventional image forming apparatus 500 is performed.

However, in the conventional image forming apparatus 500, the life of the integral-type process cartridge 526 is determined by the volume of the toner contained in the toner containing portion 524. When the toner is used up, as shown in FIG. 7, it is necessary to replace the integral-type process cartridge 526 with a new one by taking the process cartridge 526 out of the image forming apparatus 500.

In this case, the entire integral-type process cartridge 526 which includes parts the lives of which do not expire is subjected to replacement. Accordingly, still usable parts for the process cartridge 526 are to be replaced since the process cartridge 526 is replaced as the process cartridge unit.

Further, the integral-type process cartridge is ordinarily recovered and its recycling mechanism is also created. However, from the viewpoint of environmental protection which has recently received attention, the number of parts as consumable replacement parts may preferably be as small as possible in the first place.

SUMMARY OF THE INVENTION

An object of the present invention is to provide a process cartridge capable of improving usability features, such as handleability and (paper) jam treating performance, by disposing it detachably mountable to an image forming apparatus in such a state that a first unit and a second unit are connected with each other.

Another object of the present invention is to provide a process cartridge capable of cutting removing costs by reducing the number of consumable replacement parts while taking environmental protection into consideration.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

A first embodiment of the process cartridge according to the present invention will be described based on FIGS. 1-4.

Figure 1:
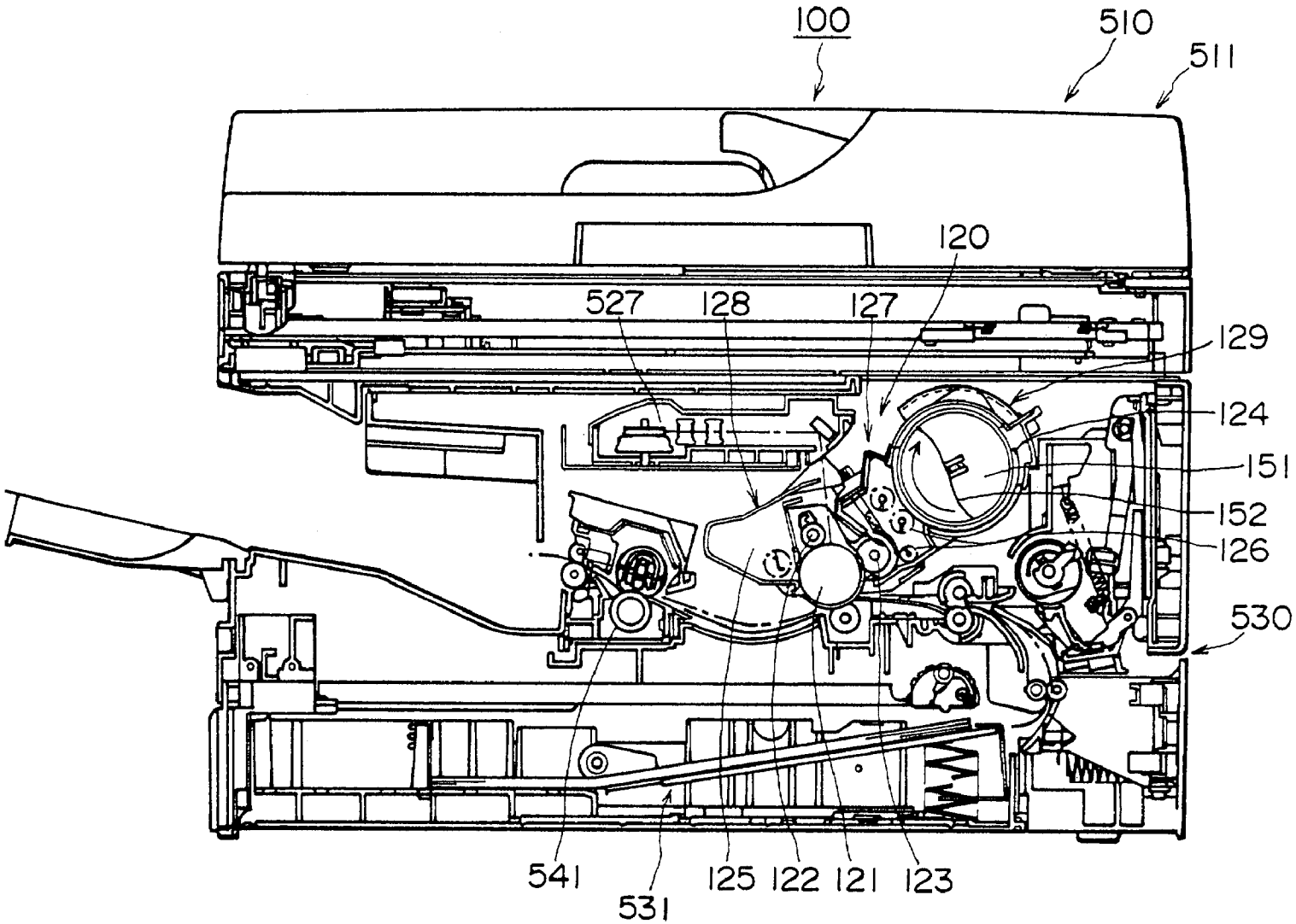
FIG. 1 is a schematic sectional view for illustrating an entire structure of an image forming apparatus (copying machine) according to Embodiment 1.
Figure 2:
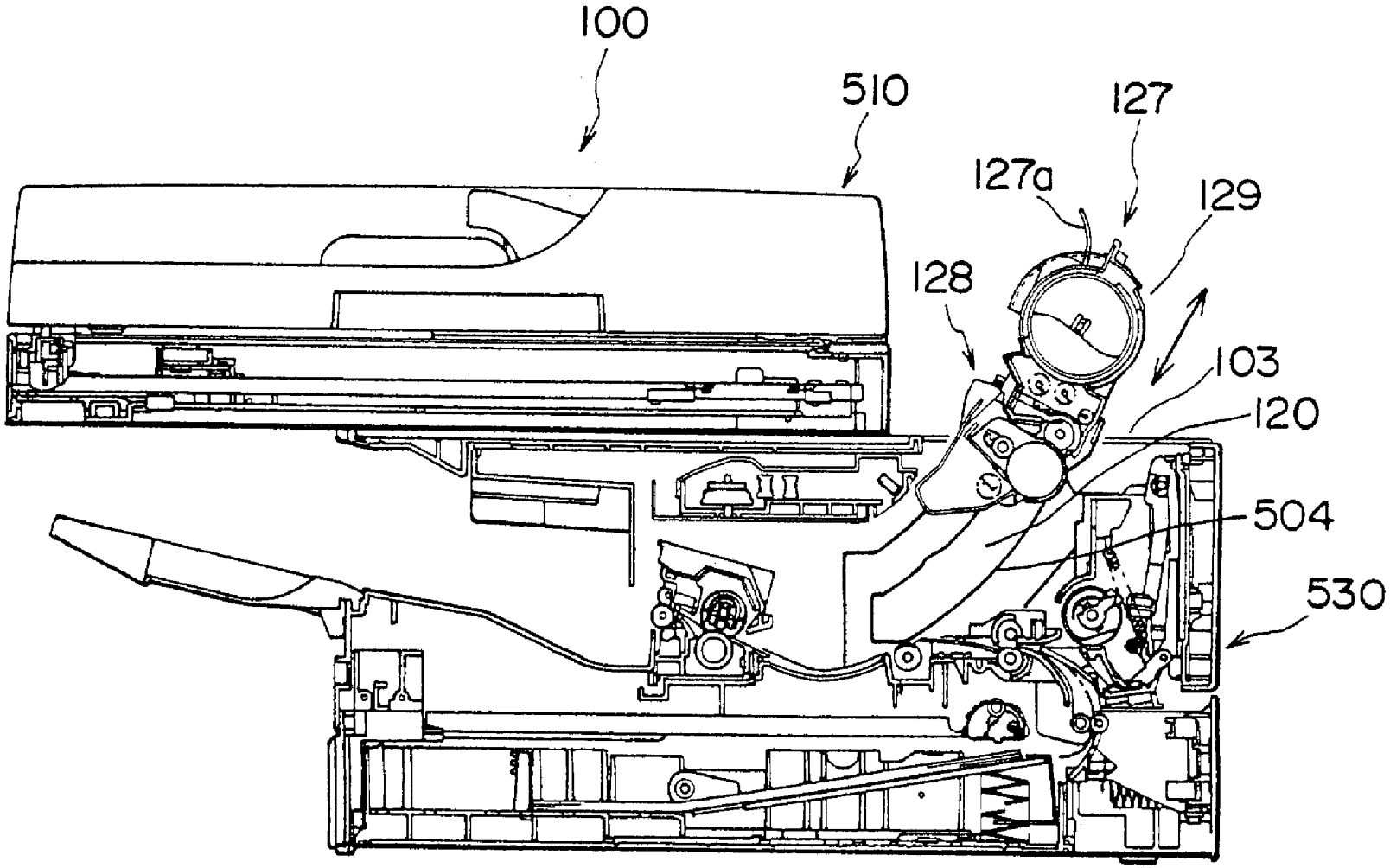
FIG. 2 is a schematic sectional view for illustrating a state of a process cartridge for the image forming apparatus at the time of mounting and demounting.
Figure 3:
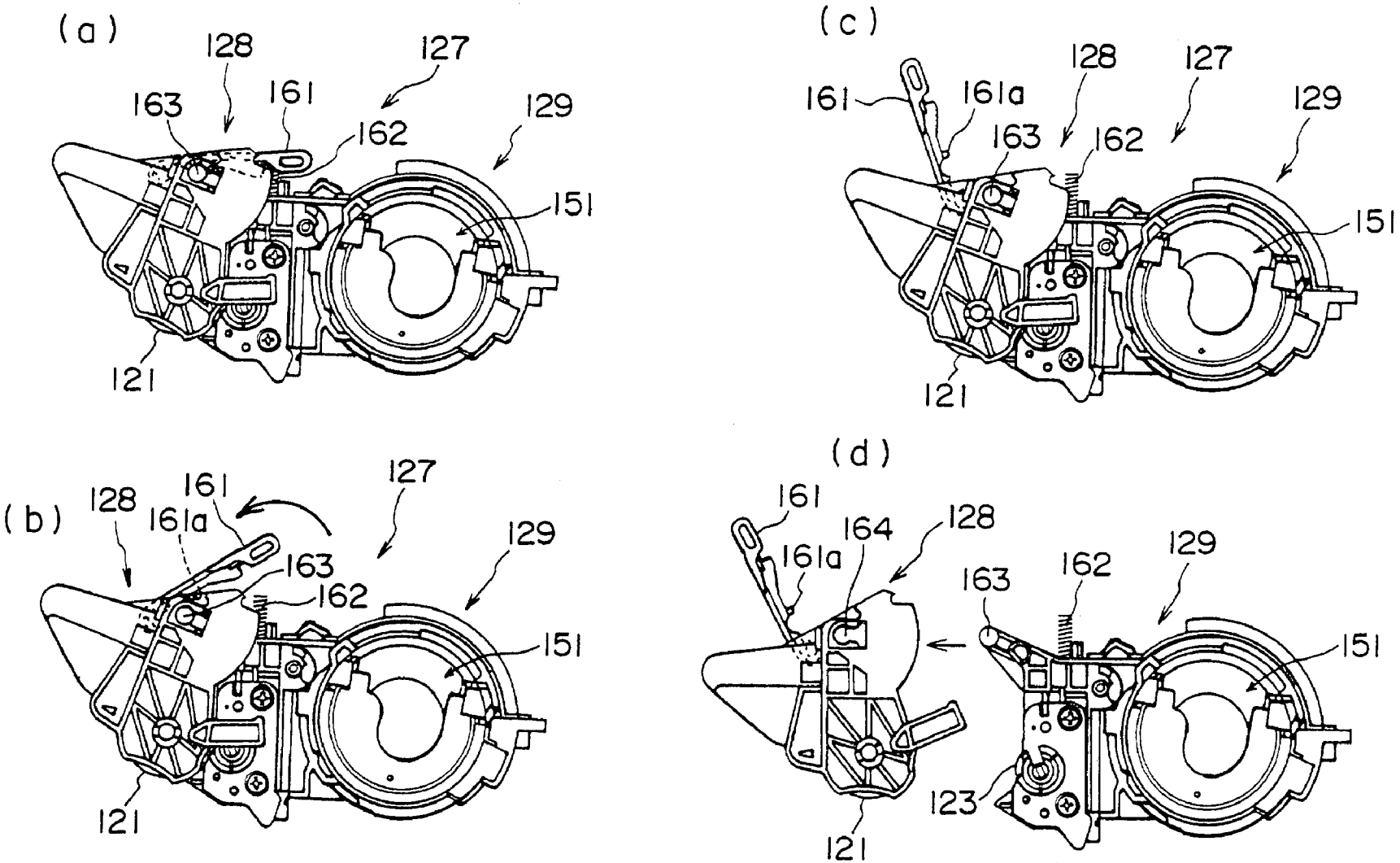
FIGS. 3(*a*)-3(*d*) are enlarged views of the process cartridge for illustrating a separating method of the process cartridge.
Figure 4:
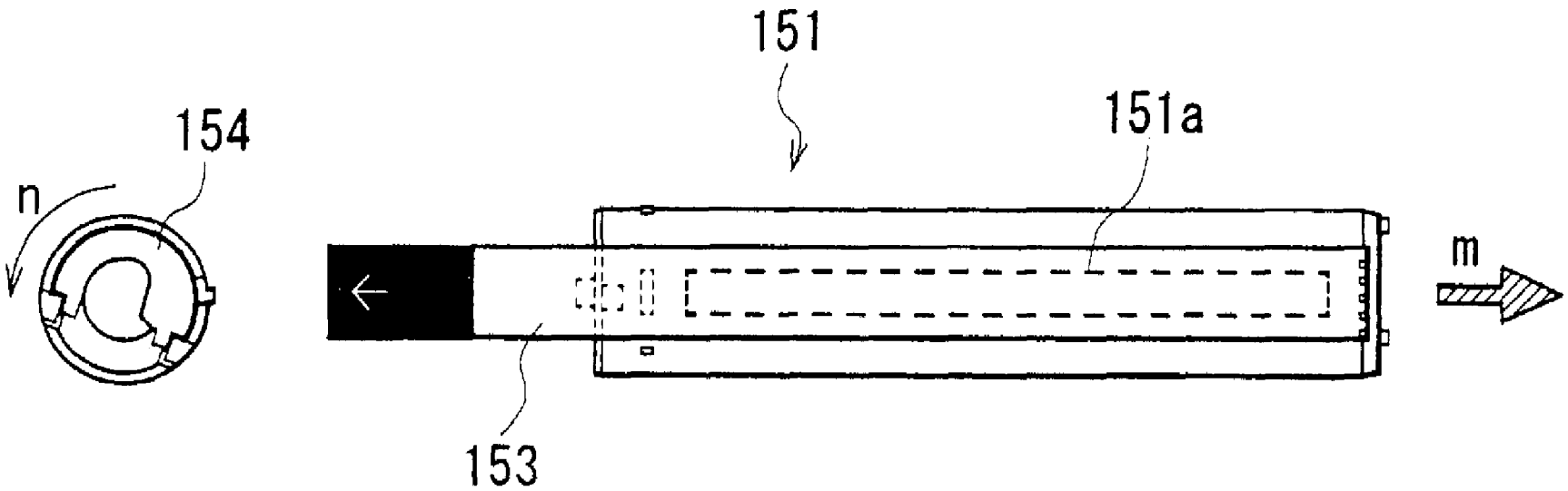
FIG. 4 is a supplementary explanation view showing a toner container.

FIG. 1 shows the entire structure of an image forming apparatus (copying machine) according to this embodiment; FIG. 2 shows a state of a process cartridge as an image forming unit for the image forming apparatus at the time of mounting and demounting; FIGS. 3(*a*)-3(*d*) are enlarged views of the process cartridge for illustrating a separating method of the process cartridge; and FIG. 4 is a supplementary explanation view showing a toner container.

An image forming apparatus 100 according to this embodiment has the same structure as the above-mentioned conventional image forming apparatus 500 except for a process cartridge 127. Parts or members of the image forming apparatus 100 identical to those of the conventional image forming apparatus 500 are indicated by the same reference numerals and explanation thereon is omitted.

<Entire Structure of the Apparatus>

The entire structure of the image forming apparatus 100 will be explained with reference to FIG. 1 with particular emphasis on its modifications.

As shown in FIG. 1, the image forming apparatus 100 of this embodiment is constituted by an original read portion 510 disposed at an upper portion of the apparatus 100, an image forming portion 120 disposed at almost central portion, and a (paper) feeding portion 530 disposed below and on the right side of the image forming portion 120. As described above, the original read portion 510 and the feeding portion 530 are identical to those in the conventional image forming apparatus 500, so that the structure of the image forming portion 120 will be described below.

To the image forming portion 120, a process cartridge 127 is mounted. As shown in FIG. 1, the process cartridge is mounted to the image forming portion 120 in such a state that a drum cartridge 128 and a developing cartridge 129, which are mutually separable cartridges for a photosensitive member, are connected to each other.

The drum cartridge 128 as a first unit includes a photosensitive drum 121 being an electrophotographic photosensitive member as an image bearing member, a charge roller 122 for charging the surface of the photosensitive drum 121, a cleaning device 125 for removing and recovering residual toner image remaining on the photosensitive drum 121 surface, etc. These members are integrally formed in a unit which is detachably mountable to the image forming apparatus 100.

The developing cartridge 129 as a second unit includes a developing roller 123 for visualizing an electrostatic latent image on the photosensitive drum 121, a toner containing portion 124 for accommodating a toner container 151 containing a toner supplied to the developing roller 123, a plurality of stirring members 126 for stirring the toner send from the toner container 151, etc. These members are integrally formed in a unit which is detachably mountable to the image forming apparatus 100.

A method of separating and connecting the drum cartridge 128 and the developing cartridge 129 will be described hereinafter.

Incidentally, within the toner container 151 of the process cartridge 127 shown in FIG. 1, a feeding lade 152 is provided for feeding the toner toward the developing roller 123.

FIG. 2 shows a state at the time when the process cartridge 127 is detached from and attached to the image forming apparatus 100. Also in the image forming apparatus 100, a user of the image forming apparatus 100 is required to perform demounting and mounting of the process cartridge 127 at the time of replacement of consumable parts within the process cartridge 127 or jam treatment of sheet(s) as a recording material at the image forming portion 120. The demounting and mounting of the process cartridge 127 is performed in such a manner that the original read portion 110 is moved horizontally in a left-hand direction as shown in FIG. 2, and from an opening portion 103 which has appeared substantially above the image forming portion 120, the integral-type process cartridge 127 may be detached from and attached to a main assembly of the image forming apparatus 100 in a direction of an indicated arrow. More specifically, the user of the image forming apparatus demounts and mounts the integral-type process cartridge 127 along a cartridge guide portion 504 while holding a fold-down gripping portion 127*a*.

As described above, the process cartridge 127 is detached and attached in a substantially vertical direction (a direction perpendicular to a rotational axis direction of the photosensitive drum 121), so that it is not necessary to ensure a large space for mounting the process cartridge 127.

Incidentally, the gripping portion 127*a* is formed of a wire member and is in a fold-down state when the process cartridge 127 is mounted in the image forming portion 120.

<Life of Cartridge>

In the process cartridge 127 for the image forming apparatus 100 according to the present invention, the photosensitive drum 121 deteriorates by wearing of its photosensitive layer with the use thereof for a predetermined time. For this reason, the drum cartridge 128 is designed as a consumable replacement part so that the user of the image forming apparatus 100 replaces the drum cartridge 128, a predetermined number of times in total, every time when the life of the drum cartridge 128 expires in successive use of the image forming apparatus 100. Incidentally, with respect to the timing of replacement, the image forming apparatus 100 is designed so that it displays a message of, e.g., "please replace the cartridge" at a liquid crystal display portion thereof to encourage the user to replace the drum cartridge when a thickness of the photosensitive layer is not more than a certain threshold value by detecting a current passing through the photosensitive drum 121 at the time of applying a predetermined voltage to the charge roller 122 disposed in contact with the photosensitive drum 121 to simulate detection of the photosensitive layer thickness every predetermined time.

Herein, the "life" means a maximum sheet number or a maximum period of image formation capable of satisfying and retaining a predetermined criterion as to qualities of an image formed on the sheet as the recording material by the image forming apparatus 100.

In this embodiment, the lives of the main assembly of the image forming apparatus 100 and the developing cartridge 129 are respectively about 10×104 sheets (A4-size, printing ratio of about 6%) as the number of image formation sheets or 5 years as the period of use, and the life of the drum cartridge 128 is about 1.9×104 sheets (A4-size, printing ratio of about 6%) as the number of image formation sheets.

As described above, the developing cartridge 129 has the life which is substantially the same as that of the image forming apparatus 100. In other words, it is not necessary for the process cartridge 127 of this embodiment to be replaced until the life of the image forming apparatus 100 expires, except for the toner container 151 containing the toner which is consumed with the image formation. The toner container 151 is designed to be replaceable with a new toner container by pulling out it from the developing cartridge 129 when the toner runs out.

The above-mentioned predetermined criterion is a criterion which is established by a manufacturer of the image forming apparatus so that qualities of an image formed on the sheet give user satisfaction.

More specifically, the substantially agreement between the lives of the main assembly of the image forming apparatus and the developing cartridge means that the replacement of the developing cartridge is not performed once until the image forming apparatus reaches its end of life. Thus, it is possible to reduce the running costs by obviating the need for replacement of the developing device. In addition, it is possible to increase usability for an operator by the reduction of replacement parts.

<Separation and Connection Between Drum Cartridge and Developing Cartridge>

FIGS. 3(*a*) to 3(*d*) show a sequence of separation procedure of the process cartridge 127 in the case of replacing the drum cartridge 128.

The drum cartridge 128 and the developing cartridge 129 are connected to each other so that they are engaged with each other by engaging an engaging protrusion 163 (connection means) of the developing cartridge 129 with an engaging portion 164 (connection means) of the drum cartridge 128 and also that the developing roller 123 and the photosensitive drum 121 (shown in FIG. 1) are disposed opposite to each other with a predetermined spacing through, e.g., a spacer. Further, the connection state is ensured by locking a release lever 161 disposed on the drum cartridge side of the process cartridge.

The replacement procedure of the drum cartridge 128 of the process cartridge 127 at the time when it reaches end of its life will be describe step by step.

FIG. 3(*a*) shows a state in which the process cartridge 127 is taken out of the image forming apparatus 100, and the drum cartridge 128 and the developing cartridge 129 are still connected to each other.

In this state, it is possible to perform the above-mentioned (paper) jam treatment. More specifically, a space corresponding to a volume of the process cartridge is obtained within the image forming apparatus, so that it is possible to expose a conveyance path of a recording material at a transfer portion for transferring a toner image from the photosensitive member (drum) to the recording material. As a result, the operator can readily remove the jammed recording material.

In the state of FIG. 3(*a*), the release lever 161 is in the engagement position. The release lever 161 engages with the engaging protrusion 163 (FIG. 3(*d*)) of the developing cartridge 129 while resisting a compression spring 162 disposed on the developing cartridge side of the process cartridge.

Incidentally, the release lever 161 is disposed on the rear side and the far side in a direction perpendicular to the drawing sheet. In the state of FIG. 3(*a*), the process cartridge 127 can be handled similarly as in the case of the above-mentioned integral-type process cartridge 516.

FIG. 3(*b*) shows a first step for separating the drum cartridge 128 and the developing cartridge 129 from each other. When the release lever 161 is rotationally moved in a direction of an arrow indicated in the figure, an engaging hook 161*a* provided to the release lever 161 is moved apart from the engaging protrusion 163.

FIG. 3(*c*) shows a state wherein the release lever 161 is moved up to its maximum released position. In this state, the drum cartridge 128 and the developing cartridge 129 are separably joined to each other.

FIG. 3(*d*) shows a state wherein the drum cartridge 128 is being separated from the developing cartridge 129. Referring to FIG. 3(*d*), the drum cartridge lighter than the developing cartridge 129 is moved in a direction of an indicated arrow relative to the developing cartridge 129 which is in a mounted state, whereby the engaging portion 164 of the drum cartridge 128 is disengaged from the engaging protrusion 163 of the developing cartridge 129.

As described above, the separation procedure of the drum and developing cartridges 128 and 129 is performed.

In order to connect again between the drum cartridge 128 and the developing cartridge 129, the above-described separation procedure is performed in reverse order after the engaging protrusion 163 is engaged into the engaging portion 164 to connect the developing cartridge 129 to the drum cartridge 128. By doing so, it is possible to replace only the drum cartridge 128 which has reached end of its life.

<Mounting of Toner Container>

FIG. 4 shows the toner container 151 containing the toner. A predetermined amount (about 200 g in this embodiment) of the toner is accommodated in the toner container 151, which is incorporated in a toner container accommodating portion 124 disposed on the developing cartridge side of the process cartridge by insertion.

Next, a method of first mounting the toner container 151 to the process cartridge 127 will be described.

The mounting of the toner container 151 may be performed in accordance with the following five steps (1)-(5).

(1) The process cartridge 127 is taken out of the image forming apparatus 100.

(2) The toner container 151 is inserted toward the toner container accommodating portion 124 in a direction of an arrow m shown in FIG. 4.

(3) A sealing member 153, which seals a toner supply port 151*a* (indicated by dashed lines in the figure), is pulled in a direction, of an arrow indicated in the sealing member 153, which is opposite from the arrow m direction, thus being removed from the toner container 151.

(4) A fold-down grip which is disposed to be foldable toward the side surface of the toner container 151 by rotating about its shaft, is raised and rotated in a direction of an arrow n shown in FIG. 4 by a predetermined angle (about 110 degrees in this embodiment) while being held by the operator. FIG. 4 shows a state in which the fold-down grip 154 is folded (after the toner container 151 is mounted into the toner container accommodating portion 124).

As a result of the rotation of the grip 154, the toner is placed in a state wherein it can be supplied from the toner supply port 151*a* to a toner receiving port of the developing cartridge 129. Further, at the time of image formation, the electrostatic image on the photosensitive drum can be developed with the supplied toner by the developing cartridge 129.

(5) The process cartridge 127 to which the toner container 151 is mounted is mounted into the image forming apparatus 100.

<Removal of Toner Container>

The removal (demounting) of the toner container 151 may be performed in accordance with the following two steps (1) and (2).

(1) After the process cartridge 127 is taken out of the image forming apparatus 100, the fold-down grip 154 is raised and held, followed by rotation in a direction opposite from the arrow n direction shown in FIG. 4.

(2) While holding the fold-down grip 154, the toner container 151 is pulled out in a direction opposite from the arrow m direction. Thereafter, a new toner container is inserted into the process cartridge in the above-described manner.

<Handling of Process Cartridge>

The handling method of the process cartridge 127 of this embodiment will be described.

The process cartridge 127 is generally detached from and attached to the image forming apparatus 100 by the user (operation) of the image forming apparatus 100 at the times of post-treatment of paper jam at the image forming portion 120, of replacement in the case where the drum cartridge 128 reaches end of life, and of replacement of the toner container 151 in the case where the toner is consumed and runs out. At such times, as described above, the handling performance of the process cartridge 127 when it is demounted and mounted can be well retained similarly as in the case of the integral-type process cartridge, so that handling of the process cartridge 127 of this embodiment can be performed with no feeling of incongruity even by the user who is practiced in handling of the integral-type process cartridge.

On the other hand, in the case where the drum cartridge 128 that has reached end of its life is replaced, the process cartridge 127 is first taken out of the image forming apparatus 100 and then the drum cartridge 128 and the developing cartridge 129 are separated from each other as described above. Thereafter, a new drum cartridge 128 is connected to the developing cartridge 129 to construct the process cartridge 127, which is then mounted in the image forming apparatus 100.

Further, in the case where the toner contained in the toner container 151 runs out, the process cartridge 127 is taken out of the image forming apparatus 100 and the toner container 151 is removed from the toner container accommodating portion 124. Then, a new toner container 151 is mounted in the toner container accommodating portion 124, and the resultant process cartridge 127 is mounted in the image forming apparatus 100.

As described above, according to this embodiment, it is possible to appropriately perform the replacement of consumable parts, such as the drum cartridge 128 and the toner container 151 only at the time when their lives expire, thus eliminating the need for replacement of the developing cartridge 129 which has the substantially same life as the image forming apparatus 100.

In the process cartridge 127 and the image forming apparatus 100 according to this embodiment, the handling of the process cartridge regarding its demounting from and mounting in the image forming apparatus is substantially equivalent to that of the integral-type process cartridge and the consumable replacement parts occurring with the use of the image forming apparatus can be minimized. As a result, it becomes possible to not only reduce the running costs but also to provide an advantageous structure in terms of environmental protection which is the subject of attention recently.

As described above, it becomes possible to provide a process cartridge and an image forming apparatus which allow good workability at the time of demounting and mounting of the process cartridge and accomplish the reduction of the consumable replacement parts.

Another Embodiment

Then, another embodiment of the present invention will be described based on FIG. 5. Incidentally, the basic structure of an image forming apparatus 200 is similar to that described in the above-mentioned embodiment. Accordingly, parts or members indicated by the same reference numerals are omitted from the following explanation.

Figure 5:
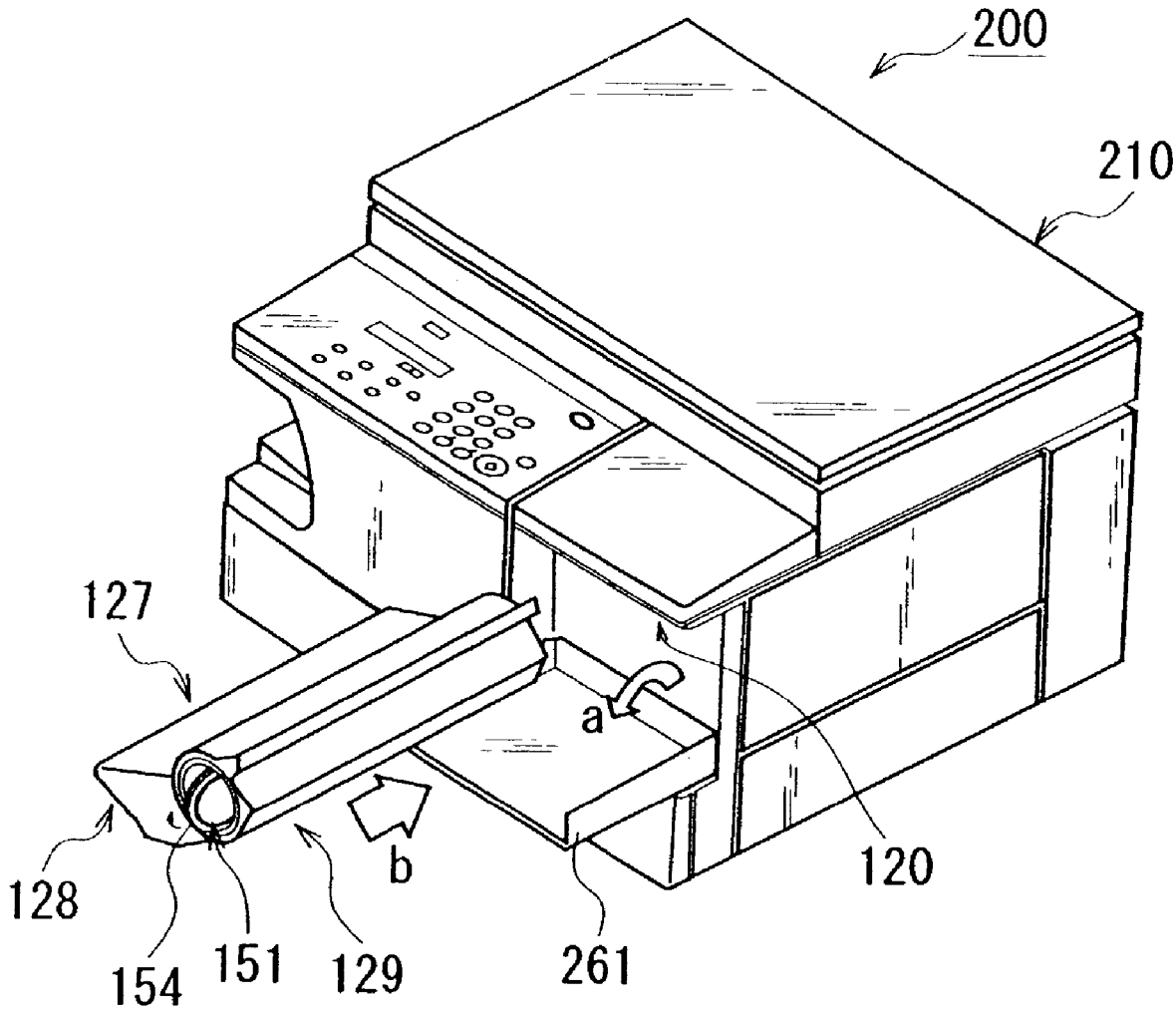
FIG. 5 is a perspective view of the entire image forming apparatus (copying machine) according to another embodiment.
Figure 6:
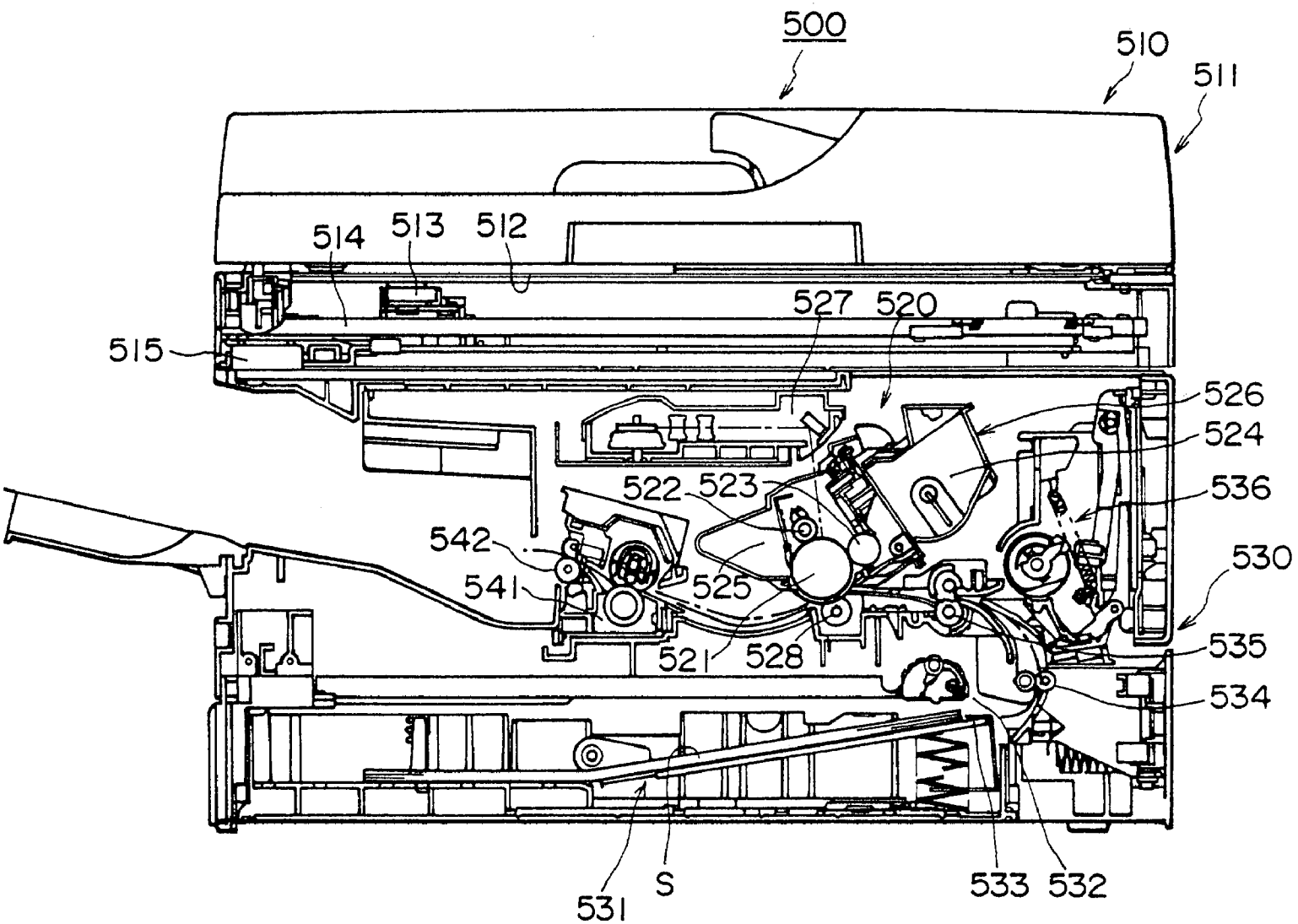
FIG. 6 is a frontal sectional view showing an entire structure of a conventional image forming apparatus (copying machine).
Figure 7:
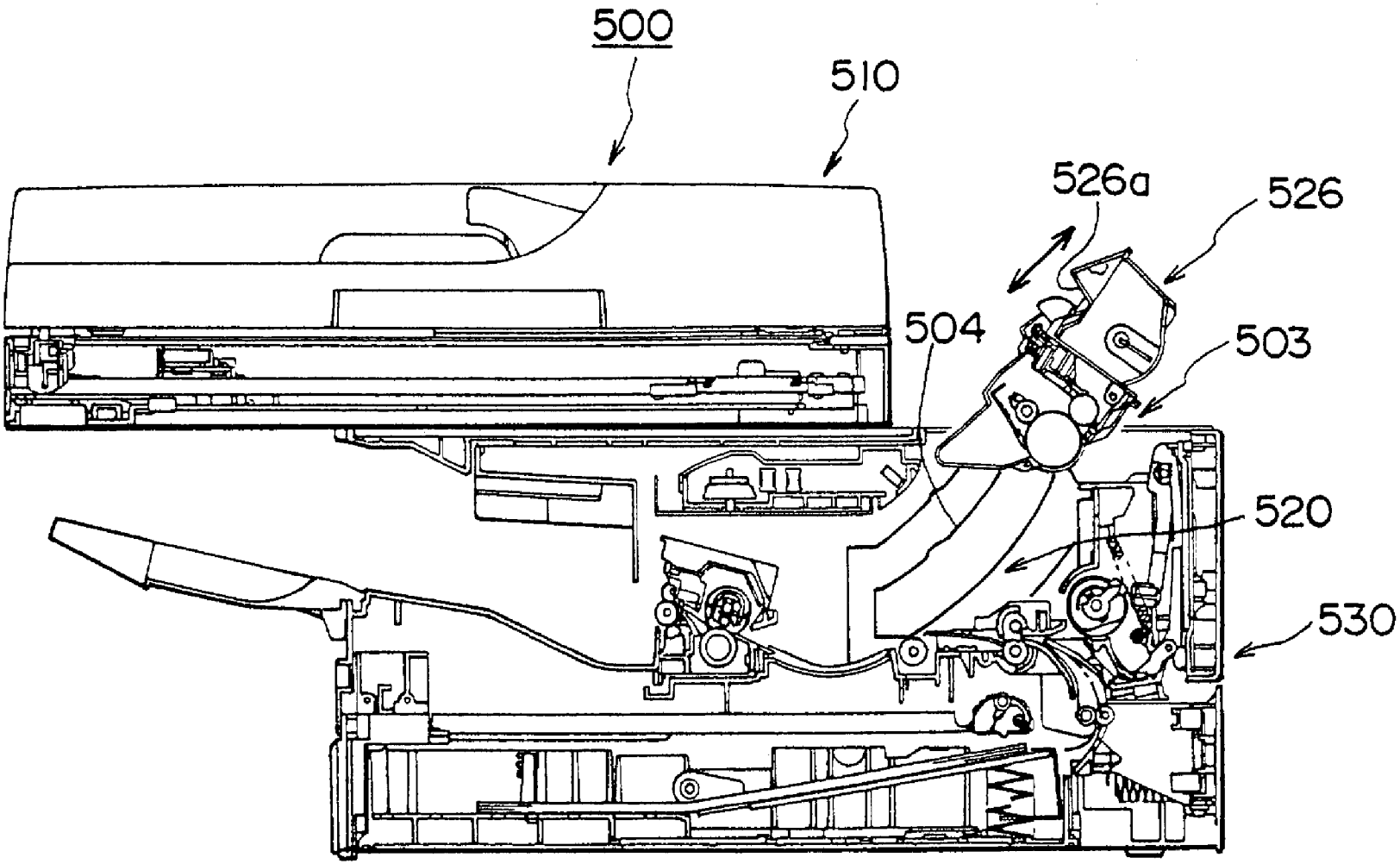
FIG. 7 is a frontal sectional view showing a state of a process cartridge for the conventional image forming apparatus at the time of mounting and demounting.

FIG. 5 is a perspective explanatory view showing the entire outward appearance of the image forming apparatus 200.

In the image forming apparatus 200, an original read portion 210 is fixed to an image forming portion 120, so that demounting and mounting of the process cartridge 127 cannot be performed by horizontally moving the original read portion 510 as shown in FIG. 2.

For this reason, in the image forming apparatus 200 of this embodiment, the operation of demounting and mounting the process cartridge 127 is performed in such a manner that a front cover 261 is opened by rotationally moving it in a direction of an arrow a indicated in FIG. 5 to expose the image forming portion 120. In FIG. 5, the case of mounting the process cartridge 127 is shown. The process cartridge 127 is mounted in the image forming apparatus 200 by inserting it toward the image forming portion 120 in a direction of an arrow b (parallel to a rotational axis direction of the photosensitive drum 121).

As described above, the image forming apparatus 200 (of this embodiment) and the image forming apparatus 100 (of the above-mentioned Embodiment 1) are only different in the direction of demounting and mounting of the process cartridge 127, thus achieving the same effects in terms of handling of the process cartridge 127 at the time of demounting and mounting, and in terms of a reduction of running costs and environmental protection.

Further, according to this embodiment, the demounting and mounting of the process cartridge 127 can be performed from the front side of the image forming apparatus 200, so that it is possible to readily demount and mount the process cartridge 127 even when space is tight above the image forming apparatus 200.

As described hereinabove, according to the respective embodiments of the present invention, it is possible to realize a reduction in running costs and to realize environmental protection by designing the image forming apparatus so as to achieve a good handleability at the time, when the process cartridge is demounted and mounted, and to allow replacement of minimum consumable parts.

More specifically, the jam treatment performance is improved by integrally taking the developing device (which is not the replacement part) together with the photosensitive member out of the image forming apparatus. In addition thereto, the photosensitive member is also designed to be replaceable, so that it is possible to compatibly realize the improvement in usability and the reduction in running costs.

What is claimed is:

1. A process cartridge detachably mountable to an electrophotographic image forming apparatus for forming a toner image on a recording material, comprising:

a first unit including at least a photosensitive member capable of bearing an electrostatic image thereon;

a second unit including at least a developing device which develops the electrostatic image on said photosensitive member with toner; and a connector which separably connects said first unit and said second unit with each other, and which permits integral mounting and demounting of said first and second units and said connector relative to the image forming apparatus, and wherein said first unit is a consumable, replaceable part whose life is substantially shorter than the image forming apparatus so as to require replacement thereof before the image forming apparatus has reached the end of its life, wherein said first unit is replaceable by separation thereof from said second unit outside the image forming apparatus, and said second unit has approximately the same life as the image forming apparatus.

2. A cartridge according to claim 1, wherein said process cartridge is disposed to be detachably mountable to the image forming apparatus in a direction substantially perpendicular to a rotation axis of said photosensitive member.

3. A cartridge according to claim 1, wherein said second unit also includes a mounting portion on which is replaceably mounted a toner container configured and positioned to supply the toner to said developing device when said process cartridge is mounted in the image forming apparatus.

* * * * *

UNITED STATES PATENT AND TRADEMARK OFFICE

CERTIFICATE OF CORRECTION

PATENT NO. : 7,269,377 B2
APPLICATION NO. : 10/461449
DATED : September 11, 2007
INVENTOR(S) : Masakazu Mori It is certified that error appears in the above-identified patent and that said Letters Patent is hereby corrected as shown below:

ON THE COVER PAGE

Item (56), References Cited, Foreign Patent Documents, "JP 07175313 A * 7/1995" should read --JP 7-175313 A * 7/1995--.

COLUMN 1

Line 32, "image" should be deleted.
Line 40, "is" should read --are--.
Line 43, "portion 530;" should read --portion 530,--.
Line 48, "roller 532;" should read --roller 532--.
Line 53, "it" should read --is--.

COLUMN 3

Line 55, "thereon" should read --thereof--.
Line 64, "at" should read --at an--.

COLUMN 4

Line 15, "image" should be deleted.
Line 24, "send" should read --supplied--.
Line 32, "lade" should read --blade--.

COLUMN 5

Line 39, "out it" should read --it out--.
Line 45, "substantially" should read --substantial--.

COLUMN 6

Line 6, "describe" should read --described--.
Line 51, "between" should be deleted.

COLUMN 7

Line 10, "in" should read --on--.
Line 50, "(operation)" should read --(operator)--.

UNITED STATES PATENT AND TRADEMARK OFFICE

CERTIFICATE OF CORRECTION

PATENT NO. : 7,269,377 B2
APPLICATION NO. : 10/461449
DATED : September 11, 2007
INVENTOR(S) : Masakazu Mori It is certified that error appears in the above-identified patent and that said Letters Patent is hereby corrected as shown below:

COLUMN 8
Line 51, "portion 510" should read --portion 210--.

Signed and Sealed this

Third Day of February, 2009

John Doll

JOHN DOLL
*Acting Director of the United States Patent and Trademark Office*